United States Patent [19]

Riihimäki

[11] 4,301,368

[45] Nov. 17, 1981

[54] IONIZING RADIATION DETECTOR ADAPTED FOR USE WITH TOMOGRAPHY SYSTEMS

[75] Inventor: Esko Riihimäki, Espoo, Finland

[73] Assignee: Hospital Physics Oy, Finland

[21] Appl. No.: 117,050

[22] Filed: Jan. 31, 1980

[51] Int. Cl.[3] ..... H01J 39/28

[52] U.S. Cl. ..... 250/385; 250/445 T

[58] Field of Search ..... 250/385, 374, 445 T

[56] References Cited

U.S. PATENT DOCUMENTS

| | | | |
|---|---|---|---|
| 3,092,747 | 6/1963 | Fine et al. | 250/374 |
| 3,703,638 | 11/1972 | Allemand et al. | 250/385 |
| 4,075,492 | 2/1978 | Boyd et al. | 250/385 |
| 4,190,771 | 2/1980 | Kamei et al. | 250/385 |
| 4,193,000 | 3/1980 | Shirayama et al. | 250/385 |

FOREIGN PATENT DOCUMENTS

| | | | |
|---|---|---|---|
| 7703944 | 4/1977 | Netherlands | 250/385 |

*Primary Examiner*—Alfred E. Smith
*Assistant Examiner*—Carolyn E. Fields
*Attorney, Agent, or Firm*—McGlew and Tuttle

[57] ABSTRACT

An improved ionizing radiation detector functioning in a proportional chamber mode, for use with X-ray tomography systems, is disclosed. The detector includes an elongated housing enclosing a chamber, a high pressure gas of great atomic weight and substantially opaque to x-radiation in the chamber, anodes and cathodes mounted in the chamber enclosed in the gas, and a voltage supply for supplying a positive voltage to the anode and a negative voltage to the cathode. The housing includes a window substantially transparent to x-radiation. The cathodes are plate-type cathodes and the anodes are composed of a plurality of metal wires extending parallel to the beam direction of the radiation to be detected at spaced intervals within a substantially claim, and the anodes and cathodes are parallel to each other. Means are provided to separately detect the voltage pulse on each anode wire.

9 Claims, 3 Drawing Figures

IONIZING RADIATION DETECTOR ADAPTED FOR USE WITH TOMOGRAPHY SYSTEMS

BACKGROUND OF THE INVENTION

The present invention relates to a radiation detector designed to be used, for example, in connection with x-ray tomography systems. The detector comprises a compact chamber with high pressure rare gas of high atomic weight. Cathodes and anodes, which are respectively connected to the negative and positive voltages of the direct current supply are located inside the chamber.

Similar ionization chambers are known which are utilized for detecting both the intensity and the location of x-rays. One example of a detector of this type is the apparatus presented in the U.S. Pat. No. 4,031,396. The said apparatus comprises an ionization chamber with gas of high atomic weight having a pressure of 10–50 atmospheres. Parallel planar anodes, separated by planar cathodes, are located inside the chamber. The planar anodes and cathodes are placed vertically towards the radiation direction. This apparatus measures the radiation intensity in analoguous form utilizing an electronic circuit, in other words, it measures the ionization current intensity. The drawback of an apparatus of this type is the comparatively slow movement of the positive ions in the chamber and the inaccuracy related the measurement of such extremely weak currents and their conversion into digital form. Crystal detectors, are also known in which the radiation intensity is expressed in analoguous form using a photomultiplier.

SUMMARY OF THE INVENTION

The above explained drawbacks can be avoided using an apparatus according to the present invention, because it can be employed for detecting each radiation quantum separately. This is achieved by using an ionization chamber according to the invention. It is characteristic of the said chamber that the cathodes are metal plates located parallel to the detected radiation beam at certain distances from each other, and that the anodes are metal leads, located between the cathodes, and forming a voltage pulse after each x-ray quantum. According to one advantageous application of the invention, the plate cathodes are situated equidistant from each other and midway between them are placed frames. The anode wires are fixed to these frames at even distances.

The apparatus according to the invention has several advantages compared to other previously known devices. The most important advantage of the invention resides in the fact since that each x-ray quantum can be separately measured, the sensitivity to interference in the signal is essentially reduced. Another very remarkable advantage is since that the pulses can be directly measured, the radiation exposure can be substantially reduced. In certain cases it is possible to use only 1/5 or 1/10 of the radiation exposure which would be necessary if prior art detectors were used.

In an apparatus according to the invention, the x-ray beams are detected in a rare gas of high atomic weight. The x-ray beams interact with the gas atoms and form a shower of ions, which consists of electrons and positively charged rare gas atoms in the presence of an electric field. The electrons, the velocity of which is remarkably higher than the velocity of the positive ions, move towards the nearest anode wire and after entering the strong electric field in the vicinity of the thin wire cause multiplication, which means that in the collisions more electrons are separated from the atoms. Amplification has thus been created. Because the field in the vicinity of the wire is extremely powerful, the electrons move very quickly and cause a rapid, detectable voltage pulse on the wire. The detector has several wires for each given point and a relatively low pressure, and, therefore, equal electron pulses can be detected at different points in succession, although the positive ions from previous shower of ions are still drifting towards the cathode. The pace of the voltage pulse caused by the positive ions is about two decades slower than that caused by the electrons, and, consequently, the pulse detection circuits can distinguish between them. This also means that, during the measuring process, it is not necessary to pulsate the x-rays themselves, but a continuous irradiation can be employed.

It is important that the radiation is detected as fully as possible, and therefore the detector has to be constructed long enough in the radiation direction, to allow at least 70 percent of the x-ray quantums to be absorbed in the gas, even if the pressure within the chamber were not particularly high. This leads to two additional advantages: first, the radiation detection takes place in a wide area so that the positive ions have time to drift to the cathodes in the chamber, and secondly, the voltage needed for the multiplication of electrons is not particularly high.

BRIEF DESCRIPTION OF THE DRAWINGS

A detailed description of the invention is given in the following by referring to the appended drawings.

DESCRIPTION OF THE PREFERRED EMBODIMENT

The x-ray beams interact with the detecting gas forming a shower of electrons and a shower of positively charged gas ions. The drift velocity of the electrons can be increased by adding some suitable molecular gas to the filling gas. The absorption probability of the x-rays depends on the atom weight of the rare gas employed and on the amount of gas molecules in the beam direction. Thus, sufficient detecting efficiency in the detector is achieved by constructing it to be adequately long in the beam direction.

The amplification of the electron pulse depends on the diameter of the wire, the potential difference between the electrodes and the pressure of the filling gas. The proportion between these elements is chosen so that a 100 to 1000 fold amplification is achieved on the lead. The measurements that have been carried out show that it is thus possible to reach voltage pulses in roughly 10 nanoseconds on the anode wire. A chamber functioning according to this principle can be called a proportional counter, although the size of the detected voltage pulse is of no importance.

Figure 1:
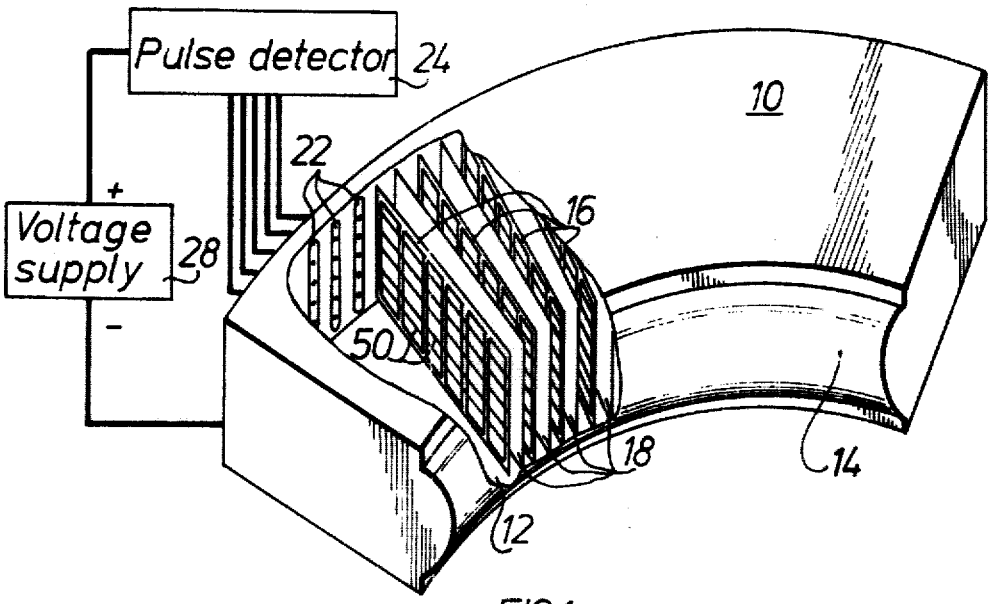
FIG. 1 is a schematic and partly cross-cut perspective view of one embodiment of the invention.

As is seen in FIG. 1, the detector according to the invention comprises an elongated curvilinear housing enclosing a pressure chamber 10. The pressure chamber has the form of a circular segment, and the point-like radiation source is placed in the center of the circle. Inside the pressure chamber 10 there is the high pressure detector gas 12. On one curvilineal side of the pressure chamber 10 there is a thin window curvilineal 14, which is substantially transparent to x-radiation. The detector gas 12 fills the pressure chamber and is substantially opaque to x-radiation, so that most of the radiation is absorbed in the gas 12. The detector gas is composed of a rare gas of high atomic weight (such as xenon) and of a molecular gas, stimulating the movability of the electrons, such as $CO_2$. The amount of the carbon dioxide $CO_2$ is preferably 5 to 10%. The cathodes, which are made of a metal of high atomic weight, are situated in the chamber in the direction of the radiation and at right angles to the lengthwise axis of the detector.

The anodes 16 are located midway between the cathodes 18 and parallel to them. The detector comprises several, possibly hundreds of cathodes and anodes. The cathodes 18 are electrically connected to the negative pole of the voltage supply 28. The wires functioning as anodes are connected to the pulse detector circuits 24 on insulated feedthroughs 22.

Figure 2:
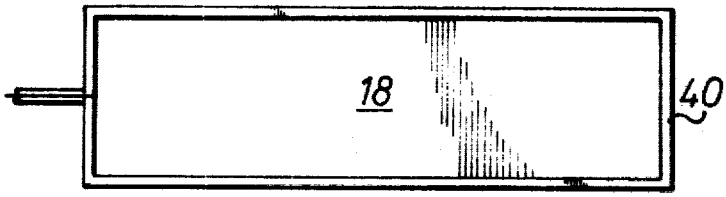
FIG. 2 is an illustration of a plate cathode for use in the detector of FIG. 1.

FIG. 2 represents a plate cathode 18, which is constructed of a metal plate of high atomic weight, the thickness of which is typically 0.05–0.1 mm, and the length of which is such that it almost reaches from the front wall of the pressure chamber to the back wall. The edges of the cathode are protected with an insulating material 40 to avoid electron leakages. The cathode plate can be made, for example, of tantalum, wolfram, molybdenum or gold.

Figure 3:
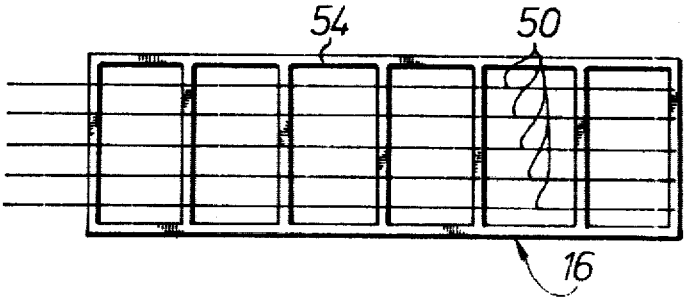
FIG. 3 is an illustration of the anode assembly for use in the detector of FIG. 1.

FIG. 3 illustrates the plate anode 16, which is roughly of the same length as the plate cathode 18 and is composed of dielectric frame 54 and the wires 50. The wires 50 are firmly fixed to the dielectric frame 54. The number of the anode wires is such that the distance between them is roughly the same as the distance between the cathodes. The frame is so thin, preferably 0.01–0.05 mm, that it substantially does not cause absorption of the radiation to be detected, but still provides a firm frame for the anode leads. The diameter of the anode wires 50 is preferably 0.02–0.1 mm, and they are made for example of wolfram, silver, steel, tantalum, gold or molybdenum.

The pulse detection from the wires on one anode can be carried out either separately or partly or by detecting every wire with a single detector. The typical distance between electrodes is 2–10 mm. The advantage of this type of detector embodiment is, that each quantum can be detected in a sufficiently short time, because computer tomography systems are characteristic of such a great amount of quantums per time unit, that each of them cannot be separately detected by using previously known detectors.

In a detector, according to the invention the detector gas 12 can be for example xenon, argon or krypton. In addition to these it is advantageous to use a small amount, for example, 5–10%, of carbon dioxide. The suitable gas pressure is between 2 and 10 atmospheres. In this case the suitable voltage is respectively between 2 and 5 kV.

The invention has above been described by referring to only one preferred embodiment. It is naturally clear that the explained embodiment is only an example and the invention is not to be limited to refer only to the said example. On the contrary, many changes in the construction of an apparatus according to the invention are possible without departing from the basic inventional idea expressed in the following patent claims.

I claim:

1. An improved ionizing radiation detector functioning in a proportional chamber mode, for use with x-ray tomography systems, comprising an elongated housing enclosing a chamber, a high-pressure gas of great atomic weight and substantially opaque to x-radiation in said chamber, anodes and cathodes mounted in said chamber enclosed in the gas, voltage supply means for supplying a positive voltage to said anodes and a negative voltage to said cathodes, said housing having a side window of a material substantially transparent to x-radiation for passing the x-radiation into said chamber, said cathodes comprising a plurality of plate cathodes spaced at intervals along the elongated axis of said housing at right angles thereto, substantially parallel to the beam direction of radiation to be detected, each of said anodes comprising a frame and a plurality of metal wires extending parallel to the beam direction at spaced intervals within a substantially common plane on said frame for supporting said wires, each of said anodes being located midway between two adjacent cathodes thereby forming a voltage pulse after each absorbed x-ray quantum, and means for separately detecting the voltage pulse on each anode wire.

2. The detector, as set forth in claim 1, wherein said cathodes are located equidistant from each other.

3. The detector, as set forth in claim 2, wherein said cathodes are made of a metal of high atomic weight selected from the group consisting of tantalum, wolfram, molybdenum or gold.

4. The detector, as set forth in claim 3, wherein said anode wires are made of a material selected from the group consisting of wolfram, silver, steel, tantalum, gold or molybdenum.

5. The detector, as set forth in claim 1, wherein the distance between the wires of each anode is substantially the same as the distance between cathodes.

6. The detector as set forth in claim 5, wherein said gas comprises a gas of high atomic weight and 5 to 10 percent of carbon dioxide, and said gas pressure is 2 to 10 atmospheres.

7. An improved ionizing radiation detector functioning in a proportional chamber mode, for use with x-ray tomography systems, comprising an elongated curvilineal housing enclosing a chamber, a high-pressure gas of great atomic weight and substantially opaque to x-radiation in said chamber, anodes and cathodes mounted in said chamber enclosed in the gas, voltage supply means for supplying a positive voltage to said anodes and a negative voltage to said cathodes, said housing having a curvilineal side comprising a curvilineal window of a material substantially transparent to x-radiation for passing the x-radiation into the said chamber, said cathodes comprising a plurality of plate cathodes spaced at intervals along the elongated curvilinear axis of said housing at right angles thereto substantially parallel to the beam direction of radiation to be detected, each of said anodes comprising a frame and a plurality of metal wires extending parallel to the beam direction at spaced intervals within a substantially common plane on said frame for supporting said wires, each of said anodes being located midway between two adjacent cathodes thereby forming a voltage pulse after each absorbed x-ray quantum, said housing having a dimension parallel to the beam direction sufficient to allow at least 70 percent of the x-ray quanta to be absorbed in the gas, and means for separately detecting the voltage pulse on each anode wire.

8. The detector, as set forth in claim 7, wherein the distance between the wires in each anode is substantially the same as the distance between the cathodes.

9. The detector, as set forth in claim 8, wherein said gas comprises a gas of high atomic weight and five to 10 percent of carbon dioxide, and said gas pressure is 2 to 10 atmospheres.

* * * * *